US005424540A

United States Patent [19]

Garcia et al.

[11] Patent Number: 5,424,540

[45] Date of Patent: Jun. 13, 1995

[54] CORONA CHARGER WIRE TENSIONING MECHANISM

[75] Inventors: Christopher S. Garcia, Rochester; Brian L. Mayou, Sodus, both of N.Y.

[73] Assignee: Eastman Kodak Company, Rochester, N.Y.

[21] Appl. No.: 293,526

[22] Filed: Aug. 19, 1994

[51] Int. Cl.[6] ..... H01T 19/00

[52] U.S. Cl. ..... 250/326; 250/324

[58] Field of Search ..... 250/326, 324; 361/229, 361/230; 355/221

[56] References Cited

U.S. PATENT DOCUMENTS 5,324,941 6/1994 Gross et al. ..... 250/324

*Primary Examiner*—Jack I. Berman

*Attorney, Agent, or Firm*—Lawrence P. Kessler

[57] ABSTRACT

A corona charger wire tensioning mechanism, for a corona charging device for applying a charge to a selected surface within an electrostatographic reproduction apparatus or the like, which facilitates corona wire replacement. The corona charging device comprises at least one corona wire, and a housing. A mechanism, located in the housing, anchors one end of the corona wire thereto and couples an electrical potential source to the corona wire. A tensioning mechanism is removably receivable in the housing in spaced relation to the anchoring mechanism. The tensioning mechanism has an anchor for securing the opposite end of the corona wire thereto, and an arm adapted to engage the housing along a line which forms a pivot axis for the tensioning mechanism. After the corona wire is easily and readily anchored to the tensioning mechanism remotely from the housing, the tensioning mechanism can be received in the housing and pivoted about the pivot axis to a position to apply a preselected tension to the corona wire.

19 Claims, 4 Drawing Sheets

CORONA CHARGER WIRE TENSIONING MECHANISM

BACKGROUND OF THE INVENTION

The present invention relates in general to charging devices such as utilized in electrostatographic reproduction apparatus or the like, and more particularly to a mechanism for facilitating corona wire replacement and easily and accurately tensioning the corona charger wires.

In typical commercial electrostatographic reproduction apparatus (copier/duplicators, printers, or the like), a latent image charge pattern is formed on a uniformly charged dielectric member. Pigmented marking particles are attracted to the latent image charge pattern to develop such image on the dielectric member. A receiver member is then brought into contact with the dielectric member, and an electric field applied to transfer the marking particle developed image to the receiver member from the dielectric member. After transfer, the receiver member bearing the transferred image is transported away from the dielectric member and the image is fixed to the receiver member by heat and/or pressure to form a permanent reproduction thereon.

The electrostatic fields for various reproduction apparatus operations are commonly provided by corona charging devices. For example, corona chargers may be used to deposit the uniform charge on the dielectric member prior to light exposure, to implement transfer of a developed image from the dielectric member to a receiver member, or to neutralize charge on the dielectric member subsequent to developed image transfer to facilitate release of the receiver member or residual marking particles from the dielectric member.

Corona chargers typically include at least one very thin corona wire, located within a housing shell held at a ground potential. The corona wire is electrically coupled to a high voltage to generate ions or charging current to charge a surface (such as the dielectric member surface) brought into close proximity with the corona wire. The corona wire is tightly suspended between insulating end blocks, supported in the housing shell, such end blocks being connected to a high voltage source for producing the ion generating condition within the corona wire.

It is important that the corona wire be maintained at a tension within a particular preselected range. This is necessary because if the tension is too high, the corona wire is easily broken, and if the tension is too low the corona wire will tend to vibrate which will materially effect the ability of the wire to provide for the desired uniform charging of the intended surface. To maintain the desired tension in the corona wire, the typical corona charging device anchors the wire to one end block and connects the other end to the opposite end block through, for example, a coiled spring connector. The spring constant of the spring connector is selected to yield tension in the corona wire within the desired preselected range.

It should be well appreciated that the high voltage of the corona wire creates a corrosive environment which adversely effects the wire. That is, the atmosphere surrounding the wire is conducive to the promotion of coating and/or pitting of the wire. Over time, such action on the corona wire will cause the wire, which by its very nature is extremely fragile, to no longer be effective in producing the desired uniform charging of the surface intended to have a charge applied thereto. As such, the corona wire has to be periodically replaced. However, due to the mounting of the corona wire under tension, it has been difficult to readily effect wire replacement.

One type of corona charging device which attempts to facilitate corona wire replacement is shown in U.S. Pat. No. 4,764,675 (issued Aug. 16, 1988, in the name of Levy et al). In the corona charging device of this patent, a pivot member mounted on an end block of the device. The pivot member is movable to a first position where the corona wire can be connected to the member while untensioned, and to a second position where the wire is held under a selected tension. However, due to the space constraints with the particular arrangement of this charging device, it is still extremely difficult to attach the corona wire to the pivot member. Thus, because of the fragile nature of the wire, the attempted attachment of the wire to the pivot member may still often cause the wire to break as it is being replaced.

SUMMARY OF THE INVENTION

In view of the foregoing discussion, this invention is directed to a corona charger wire tensioning mechanism, for a corona charging device for applying a charge to a selected surface within an electrostatographic reproduction apparatus or the like, which facilitates corona wire replacement. The corona charging device comprises at least one corona wire, and a housing. A mechanism, located in the housing, anchors one end of the corona wire and electrically couples an electrical potential source to the corona wire. A tensioning mechanism is removably receivable in the housing in spaced relation to the anchoring mechanism. The tensioning mechanism has an anchor for securing the opposite end of the corona wire thereto, and an arm adapted to engage the housing along a line which forms a pivot axis for the tensioning mechanism. After the corona wire is easily and readily anchored to the tensioning mechanism remotely from the housing, the tensioning mechanism can be received in the housing and pivoted about the pivot axis to a position to apply a preselected tensioning to the corona wire.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
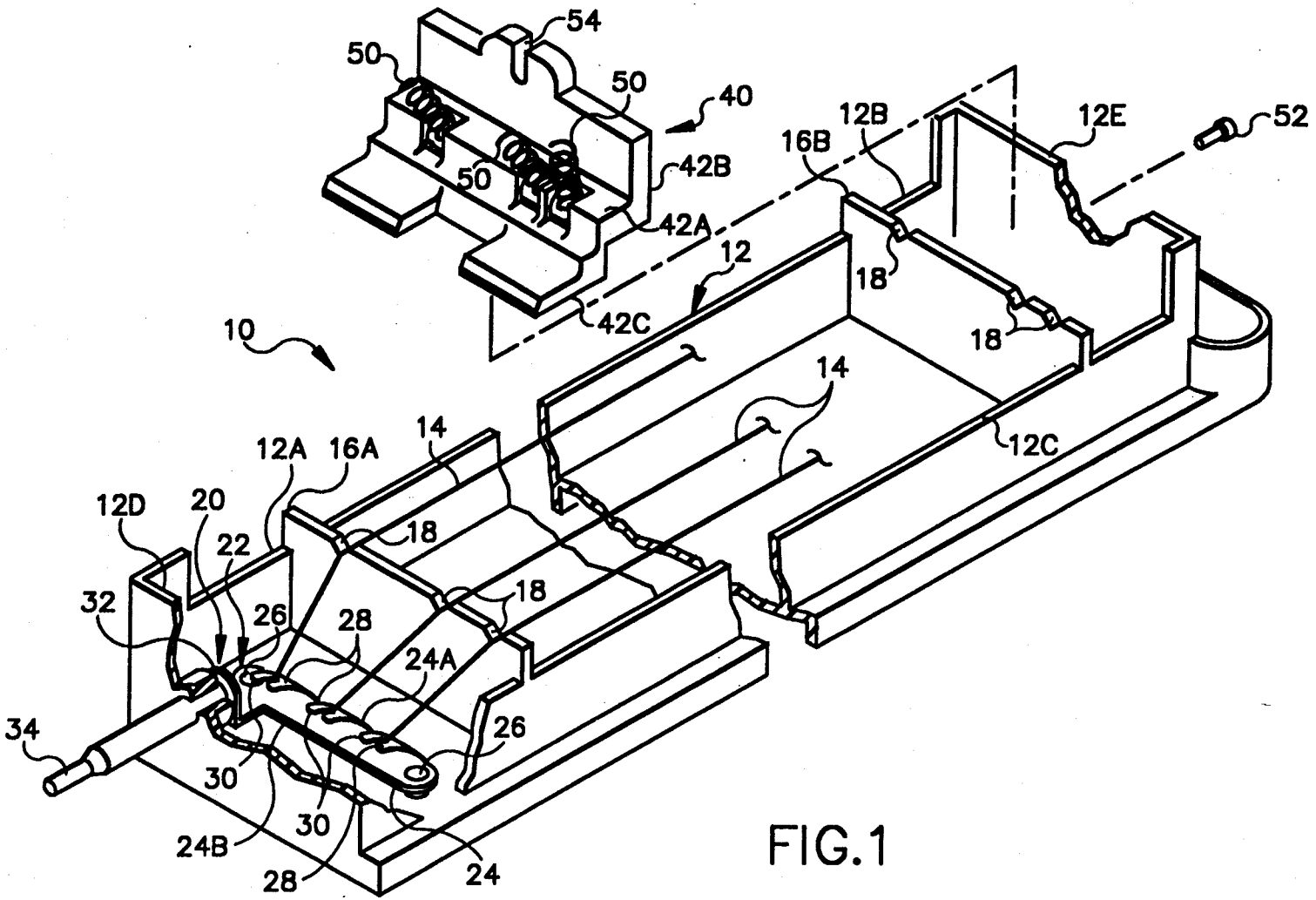
FIG. 1 is an exploded view, in perspective, of a corona charger and a corona wire tensioning mechanism, according to this invention, for the corona charger, with portions removed or broken away to facilitate viewing.

Referring now to the accompanying drawings, FIG. 1 shows a typical corona charger, designated generally by the numeral 10. The corona charger 10 is utilized, for example, for the general purpose of uniformly charging a surface in well known electrostatographic reproduction apparatus or the like. The corona charger 10 includes a housing shell 12 having a first end portion **12*a* and a second end portion 12*b* interconnected by an elongated central portion 12*c*. The housing shell 12 is formed, for example, from an insulative resin material molded in the desired shape as shown. At least one corona wire 14 (three corona wires are shown in the preferred embodiment) is supported to span the length of the central portion 12*c* of the housing shell. The central portion 12*c* is bounded at its ends by walls 16*a* and 16*b*. The walls 16*a*, 16*b* may be integrally formed with the housing shell 12, or may be separate structures connected to the housing shell in any well known manner. A plurality of V-shaped notches 18 are respectively provided in the walls 16*a*, 16*b* for supporting and locating the corona wires 14**, whereby the surface to be charged can be brought into accurate spaced association with the corona wires.

A mechanism 20 is provided in the first end portion **12*a* of the housing shell 12 for anchoring one respective end of the corona wires 14, and for electrically coupling a suitable electrical high voltage potential source to the corona wires. The mechanism 20 includes an anchor assembly 22 formed of conductive material, such as {metal} for example. The anchor assembly 22 has a body 24 connected by suitable fasteners 26 to the housing shell 12. The body 24 has a plurality of tabs 28 extending upwardly at an acute angle from the longitudinal edge 24*a* of the body. The tabs 28 respectively define slots 30 at the ends remote from the body 24. The slots 30 are adapted to respectively receive corona wires 14, which are secured to the tabs 28** by knots or loops formed in the ends of the corona wires.

Additionally, the body 24 of the anchor assembly 22 has a tab 32 extending substantially at a right angle away from the longitudinal edge **24*b* of the body. The tab 32 is connected to an electrical conductor 34 supported so as to extend through an end wall 12*d* of the housing shell 12. The conductor 34 is adapted to be coupled to a high voltage potential source (not shown), whereby the electrical potential of the source is applied to the corona wires 14 through the electrically conductive path described from the conductor 34, to the body 24 of the anchor assembly 22**, and then to the corona wires.

Figure 2:
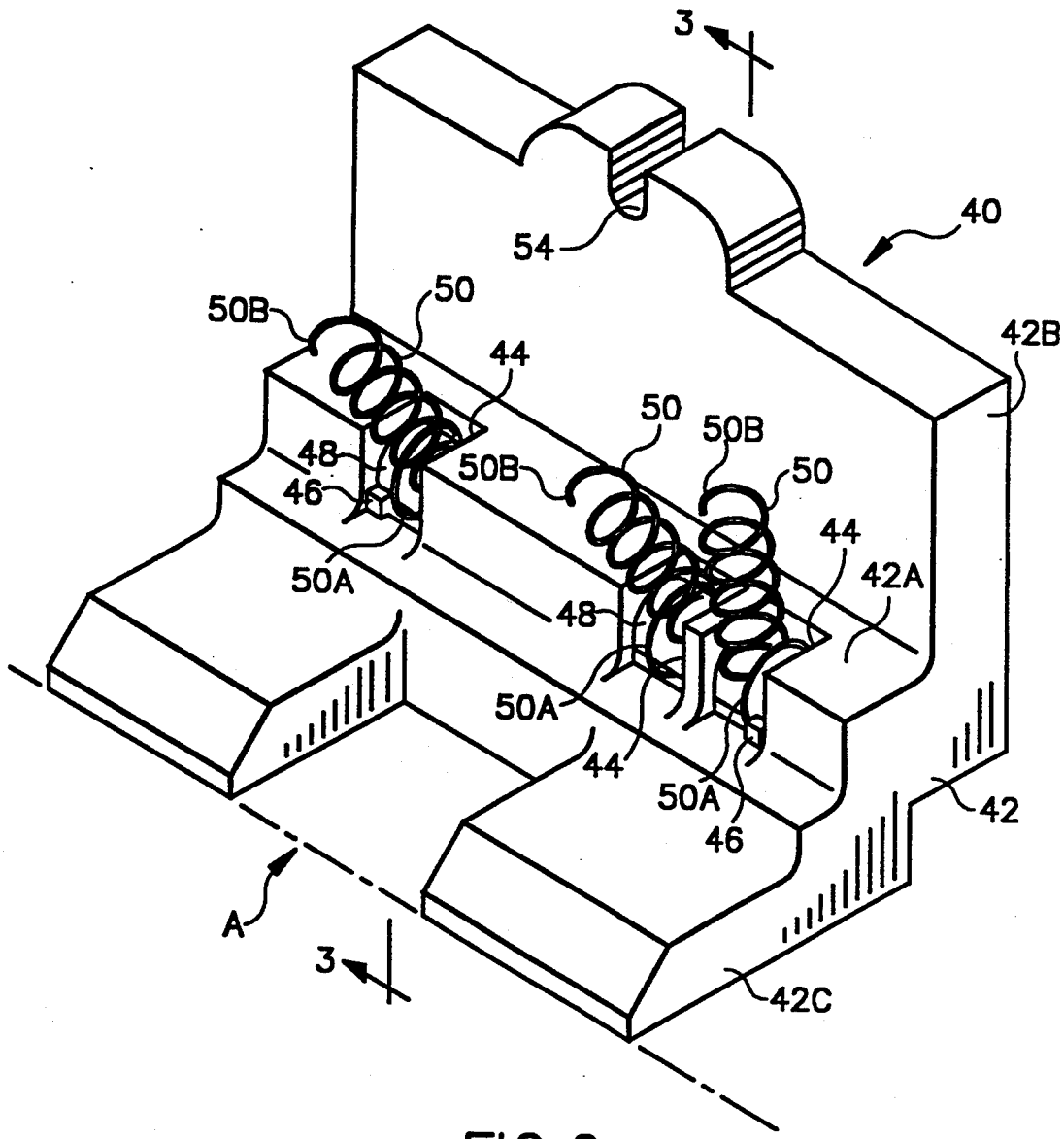
FIG. 2 is front view, in perspective and on an enlarged scale, of the tensioning mechanism according to this invention.
Figure 3:
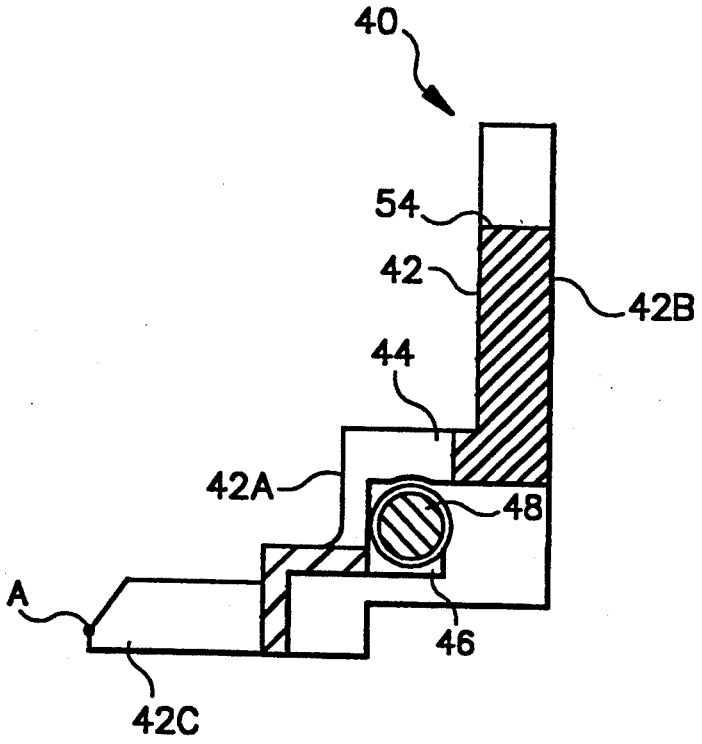
FIG. 3 is a side elevational view of the tensioning mechanism of FIG. 2, in cross-section taken along the lines 3—3 of FIG. 2.

In order to facilitate replacement of the corona wires 14 in the corona charger 10 and provide a preselected desired tensioning to the corona wires, a tensioning mechanism 40, according to this invention, is provided. The tensioning mechanism 40, as best shown in FIGS. 2 and 3, includes a substantially L-shaped body 42 having a configuration which defines a step **42*a* at the junction between the arms 42*b* and 42*c* of the body. A plurality of openings 44 are defined in the step 42*a* extending through the body. Also, the body includes a plurality of features 46 respectively extending from the rear of the step 42*a*. The features 46 cooperate with the underside surfaces of the step 42*a* to form a retainer for a shaft 48**.

The shaft 48 of the tensioning mechanism 40 serves to capture a plurality of springs 50. The springs 50, as shown in the preferred embodiment, are coiled tensioning springs. Of course, other suitable spring-like configurations, such as elastic bands for example, can be used with this invention. One end **50*a* of the respective springs is connected to the shaft 48. The springs 50 extend from the shaft 48 through the openings 44 in the step 42*a* of the L-shaped body 42. The opposite end 50*b* of the respective springs is adapted to have an end of the corona wire 14 attached thereto. The spring constant for the springs 50** is preselected to be of a value to insure that the springs will provide the desired tensioning in the corona wires on assembly.

For effecting replacement of the corona wires 14, the replacement wires are respectively secured, in the manner described above, to the tabs 28 of the anchoring assembly 22 located in the first end **12*a* of the housing shell 12. The tensioning mechanism 40 is then located conveniently relative to the housing shell 12. There, the corona wires 14 are easily and readily secured respectively to the ends 50*b* of the springs 50 (of course, the corona wires could be secured to the spring ends 50*b* first, and then secured to the anchoring assembly 22). The convenient location of the tensioning mechanism 40 is selected so that the wires are not under any tension as they are secured to the tensioning mechanism. For example, the tensioning mechanism can be positioned remotely from the end 12*b* of the housing shell 12 toward the end 12*a***. Accordingly, undue breakage of the corona wires is substantially prevented.

Figure 4:
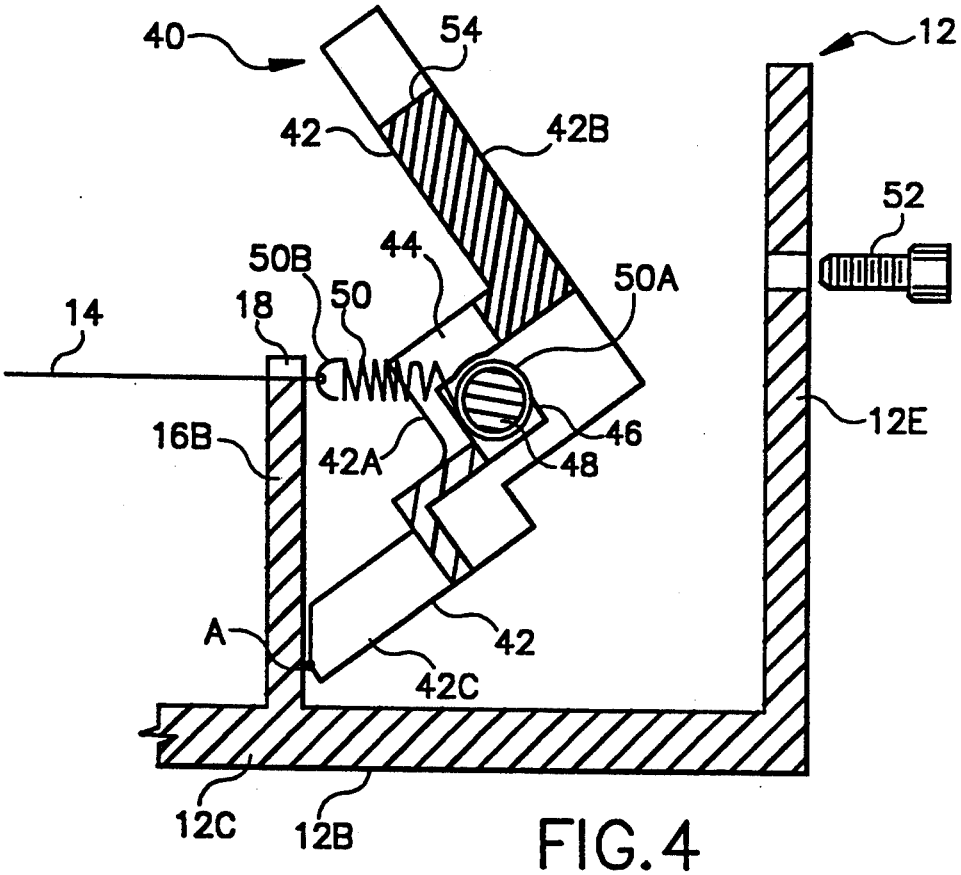
FIG. 4 is a side elevational view of the tensioning mechanism of FIG. 2, showing the tensioning mechanism in a non-tensioning orientation within the housing shell of the corona charger device of FIG. 1.

After the corona wires 14 are secured to the springs 50 of the tensioning mechanism 40, the tensioning mechanism is inserted into the end **12*b* of the housing shell 12 in the position shown in FIG. 4. In this position, it is insured that a minimum tension is applied to the corona wires as they are moved into association with the V-shaped notches 18 for accurate location within the corona charger 10. The tapered lead edge of the arm 42*c* of the tensioning mechanism 40 engages the wall 16*b* of the end 12*b* of the housing shell 12. In this position, the lead edge forms a pivot axis, designated by the letter A in FIGS. 4 and 5, for the tensioning mechanism 40**.

Figure 5:
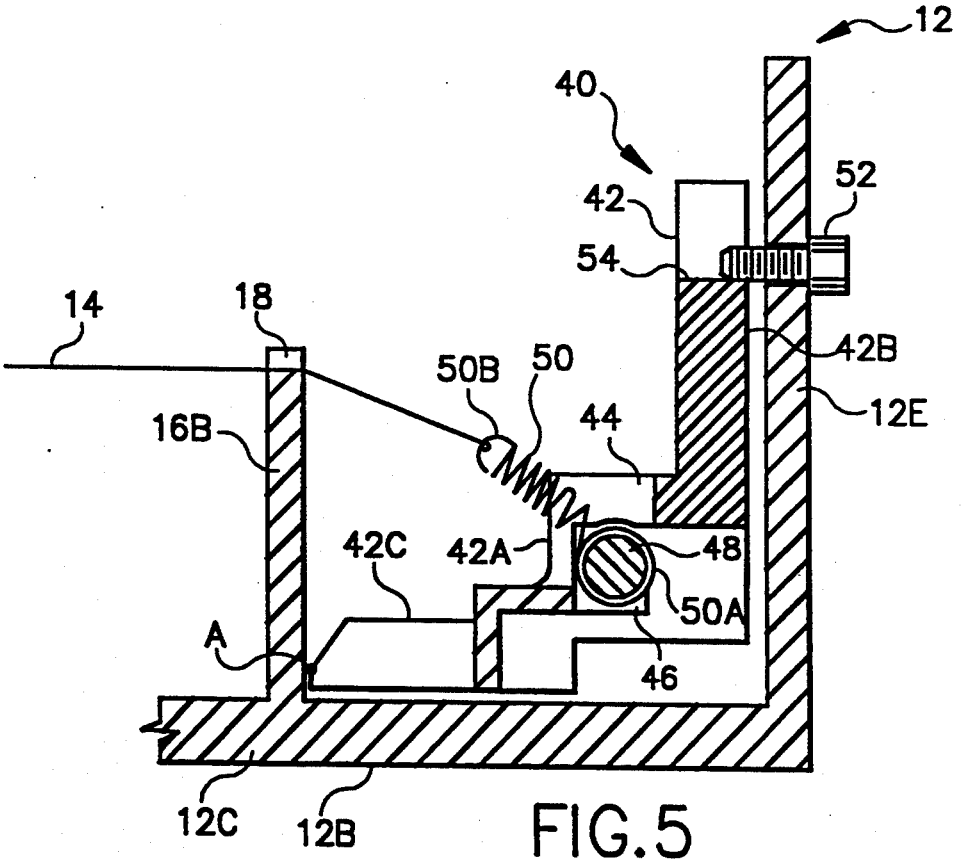
FIG. 5 is a side elevational view of the tensioning mechanism of FIG. 2, similar to FIG. 4, but showing the tensioning mechanism in a tensioning orientation within the housing shell of the corona charger device of FIG. 1.

Arm **42*b* of the tensioning mechanism 40 is conveniently used as a lever arm to enable the tensioning mechanism to be pivoted to the location shown in FIG. 5. In this position, the springs 50 will apply the desired preselected tension to the corona wires 14 to ensure proper operation of the charger 10 in an electostatographic reproduction apparatus or the like. The tensioning mechanism 40 is conveniently retained in the tension-inducing position by a set screw 52, or other similar device, inserted through the end wall 12*e* of the housing shell 12 to engage a slot 54 defined in the arm 42*b*** of the tensioning mechanism. Of course, other retaining apparatus are suitable for use with this invention.

The invention has been described in detail with particular reference to preferred embodiments thereof, but it will be understood that variations and modifications can be effected within the spirit and scope of the invention as set forth in the claims.

What is claimed is:

1. A corona charging device for applying a charge to a selected surface within an electrostatographic reproduction apparatus or the like, said corona charging device comprising:

at least one corona wire;

a housing;

means, located in said housing, for anchoring one end of said corona wire and for electrically coupling an electrical potential source to said corona wire; and a tensioning mechanism removably receivable in said housing in spaced relation to said anchoring means, said tensioning mechanism having an anchor for securing the opposite end of said corona wire thereto, and means for engaging said housing along a line which forms a pivot axis for said tensioning mechanism such that after said corona wire is easily and readily anchored to said tensioning mechanism remotely from said housing, said tensioning mechanism can be received in said housing and pivoted about said pivot axis to a position to apply a preselected tension to said corona wire.

2. The corona charging device of claim 1 wherein said anchor of said tensioning mechanism includes at least one spring attachable to said corona wire.

3. The corona charging device of claim 2 including a plurality of corona wires, and a plurality of springs connectable to said plurality of corona wires respectively.

4. The corona charging device of claim 3 including means for retaining said tensioning mechanism in said corona wire tensioning position.

5. The corona charging device of claim 1 wherein said tensioning mechanism includes a substantially L-shaped body having first and second arms, said first arm establishing said housing engaging means and said second arm being utilized to facilitate pivoting of said tensioning mechanism about said pivot axis.

6. The corona charging device of claim 5 wherein said tensioning mechanism further includes a step portion located between said first and second arms, said step portion retaining said anchor of said tensioning mechanism.

7. The corona charging device of claim 5 wherein said tensioning mechanism further includes a step portion located between said first and second arms, said step portion defining at least one opening and a plurality of features.

8. The corona charging device of claim 7 wherein said anchor includes a shaft, retained between said features and said step of said tensioning mechanism, and at least one spring, extending through said opening, attached to said shaft at one end and to said corona wire at said other end.

9. The corona charging device of claim 8 including means for retaining said tensioning mechanism in said corona wire tensioning position.

10. The corona charging device of claim 9 wherein said retaining means includes a set screw, supported by said housing, selectively engagable with said second arm of said L-shaped member.

11. The corona charging device of claim 8 including a plurality of corona wires, a plurality of tension springs connectable to said plurality of corona wires respectively, and a plurality of openings through which said plurality of springs respectively extend.

12. A corona charging device for applying a charge to a selected surface within an electrostatographic reproduction apparatus or the like, said corona charging device including at least one corona wire, a housing, means for anchoring one end of said corona wire and electrically coupling an electrical potential source to said corona wire in said housing, and a corona wire tensioning mechanism for facilitating corona wire replacement, said tensioning mechanism comprising:

a body member removably receivable in said housing in spaced relation to said housing anchoring means, anchoring means for securing the opposite end of said corona wire to said body member, and an arm adapted to engage said housing along a line which forms a pivot axis for said body member such that after said corona wire is easily and readily anchored to said body member anchoring means, remotely from said housing, said body member can be received in said housing and pivoted about said pivot axis to apply a preselected tension to said corona wire.

13. The corona charging device of claim 12 including a plurality of corona wires, and a plurality of springs connectable to said plurality of corona wires respectively.

14. The corona charging device of claim 12 wherein said body member is substantially L-shaped, having first and second arms, said first arm establishing said housing engaging arm and said second arm being utilized to facilitate pivoting of said body member about said pivot axis.

15. The corona charging device of claim 14 wherein said body member further includes a step portion located between said first and second arms, said step portion defining at least one opening and a plurality of features.

16. The corona charging device of claim 15 wherein said body member anchoring means includes a shaft, retained between said features and said step of said body member, and at least one spring, extending through said opening, attached to said shaft at one end and to said corona wire at said other end.

17. The corona charging device of claim 16 including a set screw, supported by said housing, selectively engagable with said second arm of said L-shaped member for retaining said body member in said corona wire tensioning position.

18. The corona charging device of claim 17 including a plurality of corona wires, a plurality of tension springs connectable to said plurality of corona wires respectively, and a plurality of openings through which said plurality of springs respectively extend.

19. In cooperation with a corona charging device for applying a charge to a selected surface within an electrostatographic reproduction apparatus or the like, said corona charging device including at least one corona wire, a housing, means for anchoring one end of said corona wire to said housing and electrically coupling an electrical potential source to said corona wire, and a corona wire tensioning mechanism, a method for easily and readily replacing and tensioning said at least one corona wire, said method comprising the steps of:

remotely anchoring one end of said corona wire to said tensioning mechanism;

anchoring the opposite end of said corona wire to said housing;

locating said tensioning mechanism in said housing; and pivoting said tensioning mechanism about a pivot axis to apply a preselected tension to said corona wire.

* * * * *